US006752880B2

(12) United States Patent
Ahn et al.

(10) Patent No.: US 6,752,880 B2
(45) Date of Patent: Jun. 22, 2004

(54) QUENCHED AND TEMPERED STEEL WIRE WITH EXCELLENT COLD FORGING PROPERTIES

(75) Inventors: Soon-Tae Ahn, Pusan (KR); Yukio Yamaoka, Osaka (JP)

(73) Assignee: Samhwa Steel Co., Ltd., Pusan (KR)

( * ) Notice: Subject to any disclaimer, the term of this patent is extended or adjusted under 35 U.S.C. 154(b) by 0 days.

(21) Appl. No.: 10/241,192

(22) Filed: Sep. 11, 2002

(65) Prior Publication Data

US 2003/0066576 A1 Apr. 10, 2003

(30) Foreign Application Priority Data

Sep. 14, 2001 (KR) ..... 2001-56917

(51) Int. Cl.[7] ..... C22C 38/00

(52) U.S. Cl. ..... 148/320; 148/328; 148/587; 148/595

(58) Field of Search ..... 198/320, 328, 198/587, 595

(56) References Cited

U.S. PATENT DOCUMENTS 3,877,281 A * 4/1975 Shimizu et al. ..... 72/364
4,533,401 A * 8/1985 Yutori et al. ..... 148/598
4,537,644 A * 8/1985 Tominaga et al. ..... 148/663

* cited by examiner

*Primary Examiner*—Andrew L. Oltmans
(74) *Attorney, Agent, or Firm*—Michael Best & Friedrich LLP

(57) ABSTRACT

Steel wires and steel rods with excellent cold forging properties and used in a manufacture of various machine components, which have relatively high strengths, are disclosed. The steel wires are produced by maintaining a product (n×YS) of a yield strength (YS) and a work hardening coefficient (n) obtained by a tensile test of the steel wire within a range of 4.0–11.0 kgf/$^2$, without a need of additional quenching and tempering treatments after cold forging. There is no need to perform heating for spheroidizing annealing for a long time, and it is possible to produce quenched and tempered steel wires having excellent cold forging properties by quenching and tempering treatments in a short period of time.

4 Claims, 5 Drawing Sheets

QUENCHED AND TEMPERED STEEL WIRE WITH EXCELLENT COLD FORGING PROPERTIES

BACKGROUND OF THE INVENTION

1. Field of the Invention

The present invention relates to steel wires and steel rods used in a manufacture of various components such as bolts and shafts, which have relatively high strengths, and more particularly to quenched and tempered steel wires with excellent cold forging properties, which can be produced by maintaining a new parameter relating to material quality affecting cold forging properties of the steel wires within a specific range, without additional heat treatment such as quenching and tempering.

2. Description of the Prior Art

In general, components for use in machine structures with relatively high strength, such as hexagon head bolts, U-shaped bolts, ball studs, and shafts, are produced by subjecting steel wires or steel rods (referred to as "steel wires" hereinafter) to cold forging procedures. Such components for use in machine structures are produced in such a way that steel wires are heated at a temperature of 700° C. for a period over ten hours so that structures of the steel wires are spheroidized to improve cold forging properties, as in a process indicated bellow.

Steel wire or steel rod→spheroidizing annealing for a long time→cold forging→heating at a high temperature (850° C. or more)→quenching (water or oil) →tempering→product As will be appreciated from the above, the steel wire or steel rod is necessarily subjected to heat treatment such as quenching and tempering to enhance its strength and toughness even after the cold forging, and it is necessary to perform a plurality of production procedures due to its complicated production process.

Therefore, the conventional process as described above has problems as follows, and is required to be improved in energy efficiency, productivity and working conditions.

1) Since steel wires must be subjected to spheroidizing annealing for a long time, loss of heat energy is increased and productivity is decreased.

2) Since worked steel wires are required to be additionally subjected to quenching and tempering to enhance strength and toughness of the worked steel wires in a manufacturing process, its production time is increased. In addition, working conditions are deteriorated where the worked steel wires are subjected to heat treatment in a manufacturing place. Where the heat treatment is subcontracted to an outside manufacturer, cost for heat treatment and labor for managing delivery schedules are increased, thereby complicating overall process management.

3) Owing to the problems disclosed in above items 1) and 2), reduced productivity is caused due to a heat treatment process. Therefore, there exists an urgent need to improve productivity.

As described above, improvements in productivity, manufacturing cost, working conditions and the like related to the heat treatment are actively demanded.

SUMMARY OF THE INVENTION

Accordingly, the present invention has been made keeping in mind the above problems occurring in the prior art, and an object of the present invention is to provide quenched and tempered steel wires with excellent cold forging properties, which can be produced without additional heat treatment such as quenching or tempering by performing the heat treatment prior to cold forging.

In order to accomplish the above object, the present invention provides a steel wire having quenched and tempered structure prior to a cold forging process, wherein a product (n×YS) of a yield strength (YS) and a work hardening coefficient (n), obtained by a tensile test performed with respect to the steel wire, is within a range of 4.0–11.0 kgf/mm$^2$.

The present invention also provides a steel wire produced by drawing the above steel wire, wherein a product (n×YS) of a yield strength (YS) and a work hardening coefficient (n), obtained by a tensile test performed with respect to the drawn steel wire, is within a range of 1.5–8.5 kgf/mm$^2$.

BRIEF DESCRIPTION OF THE DRAWINGS

The above and other objects, features and advantages of the present invention will be more clearly understood from the following detailed description taken in conjunction with the accompanying drawings, in which:

FIGS. 1 and 2 are graphs showing a relation between a value of "n×YS" and critical compressibility ($H_{crit}$), wherein FIG. 1 shows steel wires which are subjected to only quenching and tempering, and FIG. 2 shows steel wires which are further subjected to a drawing by reduction in area of 5–25% after the quenching and tempering;

FIG. 3*a* is a perspective view of the compression test specimen, and FIG. 3*b* is an enlarged view of a notch-portion of the specimen.

DETAILED DESCRIPTION OF THE INVENTION

This invention will be described in further detail by way of example.

Since quenched and tempered steel wires have high strength, desired products cannot be obtained merely by subjecting high strength steel wires to cold forging. As a result of a large number of studies to produce various complicated machine components from high strength steel wires by a cold forging process, a new parameter relating to material quality was found, which is expressed by an equation indicated below.

n×YS wherein, n: work hardening coefficient of a quenched and tempered steel wire obtained by a tension test, and YS: yield strength of a quenched and tempered steel wire (Kgf/mm$^2$).

Where a value of the new parameter is in a specific range, the quenched and tempered steel wire has excellent cold forging properties.

Figure 1:
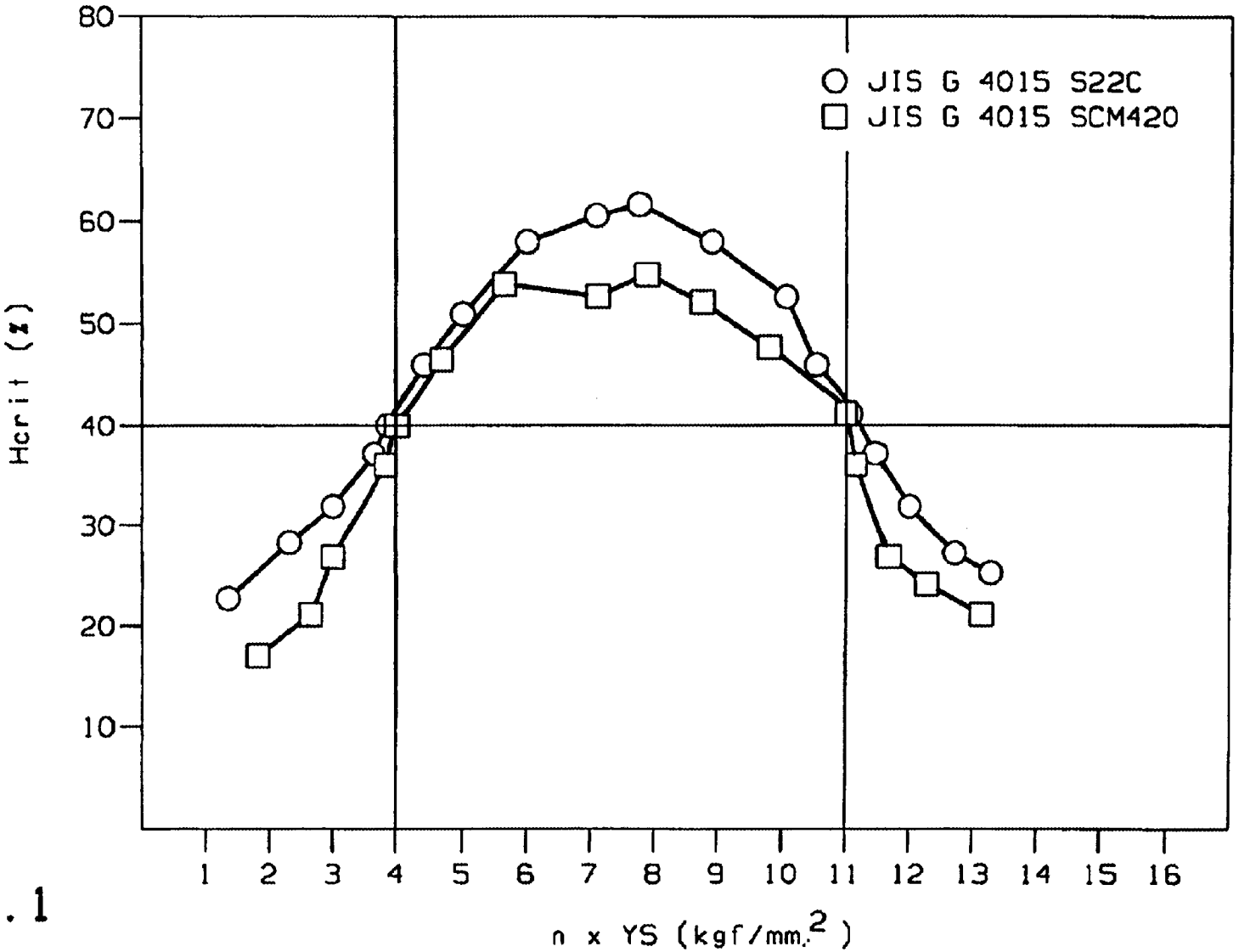
Figure 2:
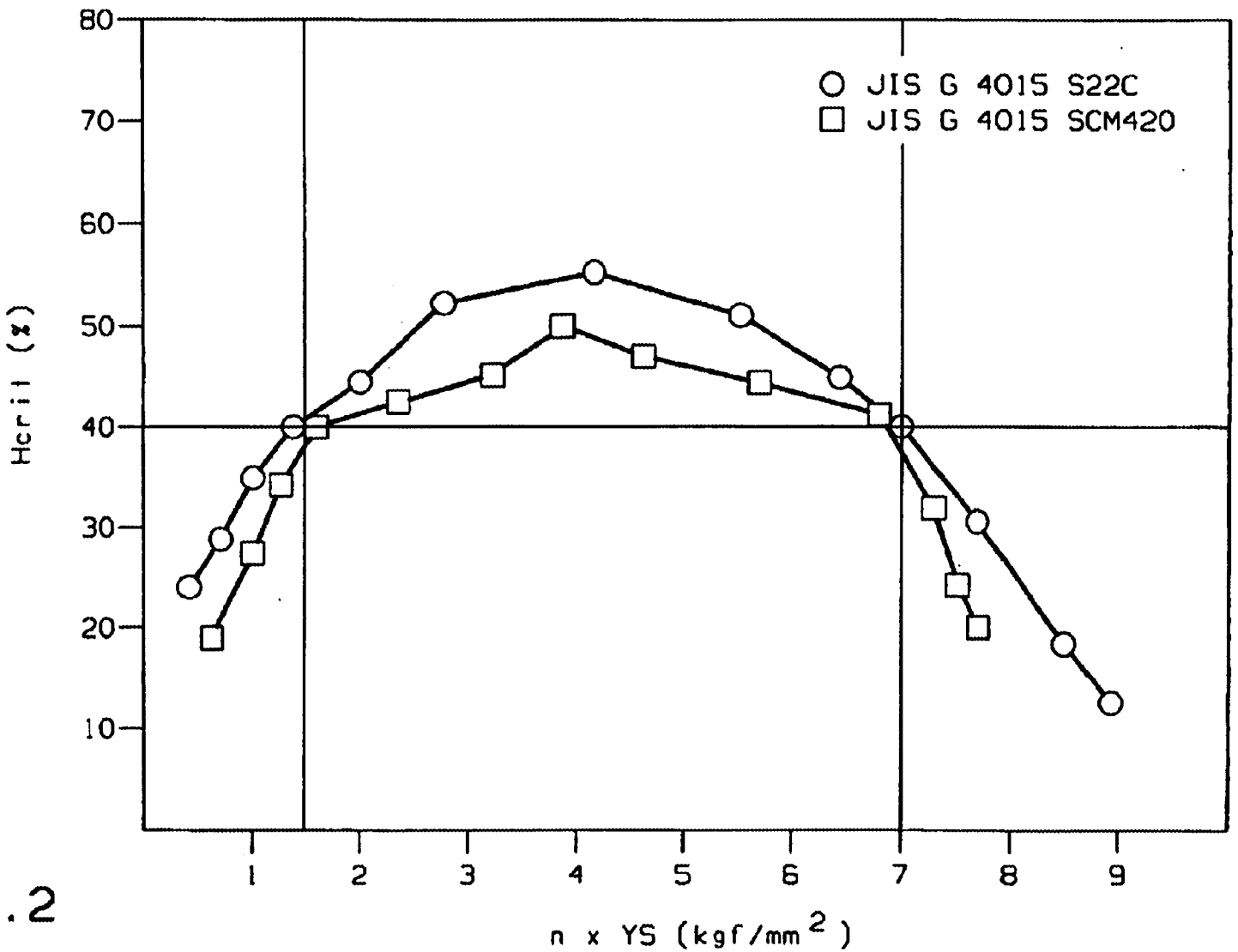

FIGS. 1 and 2 show graphs showing a relation between a value of "n×YS" and critical compressibility ($H_{crit}$), wherein FIG. 1 shows steel wires which are subjected to only quenching and tempering, and FIG. 2 shows steel wires which are further subjected to a drawing by reduction in area of 5–25% after the quenching and tempering. When the reduction in area is lower than 5%, the steel wires are severely vibrated due to interruption of the drawing and thus continuous ring marks are generated on surfaces of the steel wires. On the other hand, when the reduction in area is higher than 25%, a surface pressure and a temperature between the steel wire and drawing die become high, and thus supply of lubricant to the surface of the steel wire is interrupted, thereby causing sticking on the surface, resulting in die marks on the surface.

Preparation of specimens and measuring method associated with values of "n", "YS" and "$H_{crit}$" in FIGS. 1 and 2 are briefly described below.

A value of "YS (yield strength)" is obtained in such a way that a usual tensile test is performed and a yield strength (0.2% offset) is taken from a stress-strain diagram (S—S Curve).

A value of "n" (work hardening coefficient) is obtained in such a way that a quenched and tempered steel wire is elongated to an approximate ultimate load by a tensile test to plot an S—S Curve, the S—S curve is converted to a true stress—true strain curve (σ-ϵ curve), a logarithmic value of the σ-ϵcurve is calculated, and the "n", value is obtained from an inclination of the curve. In a measuring range of an "n" value, a steel wire, which has been subjected to only quenching and tempering, is a nominal elongation percentage of 2.0–4.0%, and a steel wire, which has been subjected to drawing after the quenching and the tempering, is within a range between yield load and ultimate load because a measurable elongation percentage of the "n" value varies with a reduction in area of the steel wire.

Figure 3A:
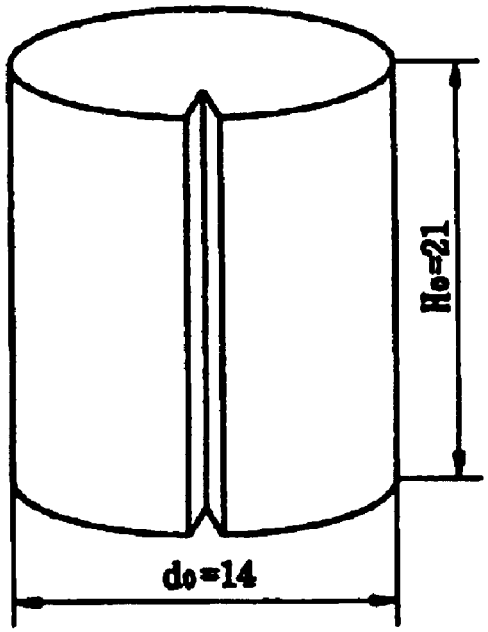
FIGS. 3*a* and 3*b* shows a compression test specimen.
Figure 3B:
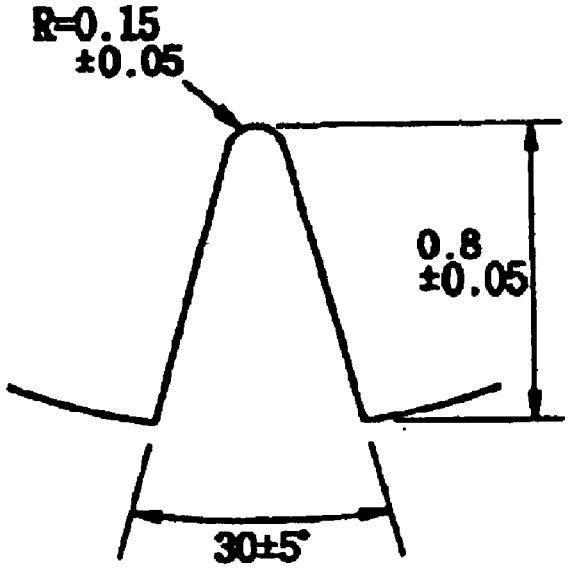

A "H.sub.crit" value is obtained in such a way that a specimen is formed with a V-shaped notch as shown in FIG. 3*a*, the specimen is compressed to various heights, and the critical compressibility is calculated by an equation disclosed below when a crack of 1mm is generated at the bottom of V-notch.

$$H_{crit} = \frac{H_0 - H_1}{H_0} \times 100(\%)$$

The "n" value is changed by changing an elongation percentage (G/L=8*d*) by control of a tempering temperature. Also, it is found that the higher an elongation percentage becomes, the higher a "n" value becomes. When a tempering temperature is higher than 750° C., some austenite is generated during heating and then the austenite is transformed to martensite by cooling after the tempering, thereby causing the metal to be brittle. Therefore, it is impossible to perform tempering at a temperature of 750° C. or more, and it is thereby difficult to increase an "n" value by more increase of an elongation percentage.

To obtain a high "n" value, an austenitizing heating temperature is changed to a temperature of 1100–1300° C. to increase a size of austenite grains to the maximum size of 90 μm and tempering is performed at high temperature. Since the procedures of heating-quenching-tempering are continuously performed by high-frequency induction heating, a time period required for heating+holding is maintained at 40 seconds.

Values of $H_{crit}$ and n×YS are also calculated from steel wires of 5–25% drawn after quenching and tempering heat treatment as above.

From FIGS. 1 and 2, it will be appreciated that the value of $H_{crit}$ is severely affected by a new parameter of "n×YS". In the V-notch compression test, it is found that cold forging properties are excellent at a critical compressibility ($H_{crit}$) of 40% and more, as a result of several field tests. Consequently, the value can be used as a reference index for cold forging. According to the present invention, it is apparent that quenched and tempered steel wires with excellent cold forging properties can be produced if the conditions disclosed below are satisfied. Accordingly, it can be appreciated that the reference index is an important parameter for production of quenched and tempered steel wires with excellent cold forging properties.

When steel wires are subjected to drawing after the quenching and tempering, n×YS=1.5–8.5 kgf/mm$^2$.

When steel wires are subjected to elongation after the quenching and tempering, n×YS=1.5–8.5 kgf/mm$^2$.

Furthermore, it is newly found that the parameter can be applied regardless of composition of quenched and tempered alloy steel wires, carbon steel wires and the like, from comparisons of SCM420 and S22C in FIGS. 1 and 2. Also, it is apparent that the heating manner is not limited to the high-frequency heating, and the new parameter can be applied to batch type quenched and tempered steel wires.

The present invention will be more clearly understood from the following example.

As raw material of steel wires, JIS G 4105 SCM420(C 0.21%, Si 0.22%, Mn 0.75%, P 0.012%, S 0.009%, Cr 1.10%, Mo 0.23%), and JIS G 4015 S22C(C 0.23%, Si 0.22%, Mn 0.58%, P 0.010%, S 0.008%) are used.

Steel wires with a diameter of 16 mm are drawn to a diameter of 14.7 mm, and a heating temperature is changed to a temperature of 880–1300 ° C. by a high-frequency induction heating device (a time period required for heating and holding of the steel wire is 40 seconds). By this heating, a size of austenite grains (γ grain size) can be changed to a range of 5–90 μm. Subsequently, the steel wires are rapidly cooled. The cooled steel wires are subjected to a tempering procedure in such a way that the steel wires are heated and held at a temperature of 200–750° C. by high-frequency induction heating for a time period of 40 seconds and then cooled by water. The tempered steel wires are treated with zinc phosphate which is a usual lubricating coating agent for cold forging. Thereafter, the steel wires are drawn by a reduction in area of 5–25%, thereby obtaining specimens.

Values of a work hardening coefficient (n), a yield strength (YS), a critical compressibility ($H_{crit}$), a tensile strength (TS) and an elongation percentage after fracture for the quenched and tempered steel wires are calculated. Machine components (hexagon headed flange bolts), as shown in FIG. 4, are prepared from the above-mentioned steel wires by cold forging, and whether a crack is generated at the machine components is checked to verify performance of the present invention.

Figure 4:
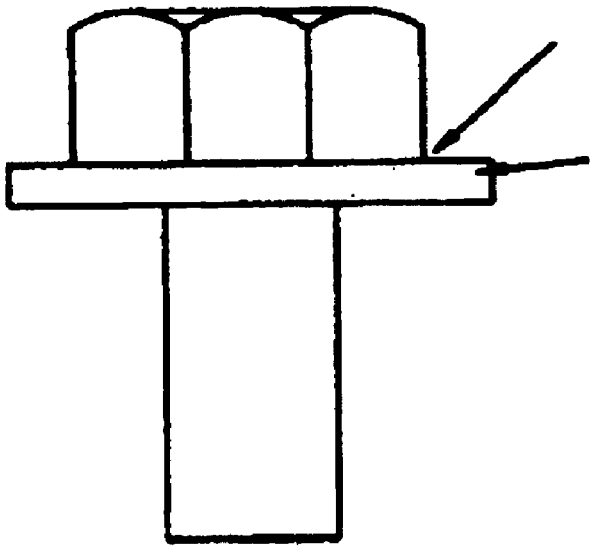
FIG. 4 is a front view of a usual hexagonal headed flange bolt, in which an area apt to have cracks is indicated by an arrow.

Since the components are apt to have cracks at a portion indicated by an arrow in FIG. 4, presence of cracks at the portion is adopted as a reference index for cold forging properties.

Table 1 shows various properties of steel wires which are produced from SCM420 by only quenching and tempering treatments, and Table 2 shows various properties of steel wires which are produced from S22C by only quenching and tempering treatments. As appreciated from Tables 1 and 2, all steel wires according to the present invention, which have "n×YS" values in a range of 4.0–11.0 kgf/mm$^2$, show critical compressibility ($H_{crit}$) of 40% and more, regardless of steel species. Furthermore, from the fact that none of actual components which are worked by cold forging have cracks, excellent cold forging properties of quenched and tempered steel wires according to the present invention can be verified. A fact to be particularly emphasized is that a value of "n×YS" varies depending on a value of "n" even if the steel wires have similar tensile strengths, regardless of a level of tensile strength (TS). Therefore, it can be appreciated that the cold forging properties such as a critical compressibility ($H_{crit}$) vary according to the value of "n×YS". This is the essential point of the present invention.

Table 3 shows various properties of steel wires which are produced from SCM420by drawing after the quenching and tempering treatments, and Table 4 shows various properties of steel wires which are produced from S22C by drawing after the quenching and tempering treatments. From these Tables 3 and 4, it will be appreciated that steel wires, which are drawn to have a reduction in area of 5–25% and have a value of "n×YS" in a range of 1.5–8.5 kgf/mm$^2$, are excellent in cold forging properties.

TABLE 1

| | Various properties of SCM420 steel wires (quenched and tempered) | | | | | | | | |
|---|---|---|---|---|---|---|---|---|---|
| | Yield strength (Kgf/mm$^2$) | n value | n × YS (Kgf/mm$^2$) | Tensile strength (Kgf/mm$^2$) | Elongation (%) | γ grain size (μm) | Hcrit (%) | Crack | Remark |
| 1 | 143.0 | 0.02 | 2.86 | 158.5 | 7.1 | 8.0 | 21.5 | presence | *comp |
| 2 | 126.0 | 0.03 | 3.78 | 149.4 | 8.8 | 8.0 | 33.3 | presence | *comp |
| 3 | 106.3 | 0.04 | 4.25 | 137.3 | 12.0 | 8.2 | 42.4 | none | *inven |
| 4 | 101.6 | 0.05 | 5.08 | 139.1 | 15.1 | 30.6 | 47.6 | none | *inven |
| 5 | 118.0 | 0.09 | 10.62 | 136.0 | 13.0 | 42.5 | 43.8 | none | *inven |
| 6 | 110.0 | 0.06 | 6.60 | 125.0 | 14.5 | 10.0 | 52.1 | none | *inven |
| 7 | 100.0 | 0.07 | 7.00 | 115.0 | 17.0 | 8.0 | 52.0 | none | *inven |
| 8 | 91.0 | 0.15 | 13.65 | 110.5 | 17.5 | 77.1 | 18.8 | presence | *comp |
| 9 | 103.5 | 0.06 | 6.21 | 118.6 | 16.0 | 25.0 | 52.2 | none | *inven |
| 10 | 92.0 | 0.09 | 8.28 | 107.4 | 18.5 | 12.4 | 53.1 | none | *inven |
| 11 | 84.0 | 0.10 | 8.40 | 92.0 | 19.0 | 12.3 | 54.5 | none | *inven |
| 12 | 75.0 | 0.10 | 7.50 | 85.0 | 20.0 | 11.2 | 53.9 | none | *inven |
| 13 | 73.1 | 0.14 | 10.23 | 86.0 | 22.0 | 41.3 | 46.6 | none | *inven |
| 14 | 68.1 | 0.16 | 10.90 | 80.5 | 25.9 | 68.2 | 42.1 | none | *inven |
| 15 | 65.2 | 0.12 | 7.82 | 75.0 | 24.0 | 33.5 | 52.4 | none | *inven |
| 16 | 62.3 | 0.18 | 11.21 | 72.2 | 28.1 | 80.0 | 38.8 | presence | *comp |
| 17 | 64.2 | 0.14 | 8.99 | 70.0 | 25.0 | 38.5 | 52.0 | none | *inven |
| 18 | 61.7 | 0.20 | 12.34 | 72.0 | 29.8 | 78.0 | 27.5 | presence | *comp |
| 19 | 63.1 | 0.16 | 10.10 | 72.1 | 25.5 | 48.0 | 46.3 | none | *inven |
| 20 | 68.0 | 0.04 | 2.72 | 77.0 | 14.5 | 5.0 | 20.0 | presence | *comp |

Note:
*comp = comparative wire
*inven = wire according to the present invention

TABLE 2

| | Various properties of S22C steel wires (quenched and tempered) | | | | | | | | |
|---|---|---|---|---|---|---|---|---|---|
| | Yield strength (Kgf/mm$^2$) | n value | n × YS (Kgf/mm$^2$) | Tensile strength (Kgf/mm$^2$) | Elongation (%) | γ grain size (μm) | Hcrit (%) | Crack | Remark |
| 1 | 145.0 | 0.02 | 2.90 | 158.0 | 7.0 | 8.0 | 29.5 | Presence | *comp |
| 2 | 129.0 | 0.03 | 3.87 | 151.1 | 8.9 | 8.0 | 37.7 | Presence | *comp |
| 3 | 124.7 | 0.03 | 3.74 | 141.5 | 11.8 | 10.0 | 36.9 | Presence | *comp |
| 4 | 106.8 | 0.04 | 4.27 | 135.1 | 12.8 | 18.8 | 42.3 | none | *inven |
| 5 | 118.1 | 0.11 | 12.99 | 136.6 | 17.2 | 43.0 | 26.5 | presence | *comp |
| 6 | 108.0 | 0.06 | 6.48 | 124.8 | 14.5 | 11.0 | 58.5 | none | *inven |
| 7 | 109.0 | 0.07 | 7.63 | 124.4 | 17.0 | 8.5 | 61.0 | none | *inven |
| 8 | 102.2 | 0.11 | 11.24 | 116.0 | 17.5 | 34.5 | 38.9 | presence | *comp |
| 9 | 87.4 | 0.12 | 10.49 | 101.6 | 18.8 | 25.0 | 44.5 | none | *inven |
| 10 | 104.4 | 0.08 | 8.35 | 118.1 | 17.8 | 12.5 | 57.1 | none | *inven |
| 11 | 96.6 | 0.13 | 12.56 | 107.1 | 19.0 | 88.4 | 28.4 | presence | *comp |
| 12 | 86.5 | 0.11 | 9.52 | 98.6 | 19.5 | 28.5 | 52.9 | none | *inven |
| 13 | 75.9 | 0.14 | 10.63 | 87.1 | 21.5 | 38.1 | 44.3 | none | *inven |
| 14 | 74.5 | 0.12 | 8.94 | 86.4 | 22.0 | 33.0 | 55.1 | none | *inven |
| 15 | 63.8 | 0.17 | 10.85 | 81.2 | 25.0 | 72.3 | 42.6 | none | *inven |
| 16 | 66.2 | 0.15 | 9.93 | 75.2 | 24.0 | 40.0 | 52.1 | none | *inven |
| 17 | 62.4 | 0.18 | 11.23 | 72.2 | 28.8 | 80.0 | 38.7 | presence | *comp |
| 18 | 63.5 | 0.16 | 10.16 | 73.1 | 25.0 | 38.0 | 48.1 | none | *inven |
| 19 | 63.0 | 0.15 | 9.45 | 72.4 | 26.5 | 45.0 | 52.0 | none | *inven |

TABLE 2-continued

Various properties of S22C steel wires (quenched and tempered)

| | Yield strength (Kgf/mm$^2$) | n value | n × YS (Kgf/mm$^2$) | Tensile strength (Kgf/mm$^2$) | Elongation (%) | γ grain size (μm) | Hcrit (%) | Crack | Remark |
|---|---|---|---|---|---|---|---|---|---|
| 20 | 57.0 | 0.23 | 13.11 | 68.6 | 30.1 | 90.0 | 26.5 | presence | *comp |
| 21 | 68.9 | 0.04 | 2.76 | 78.0 | 15.1 | 5.7 | 29.0 | presence | *comp |

Note:
*comp = comparative wire
*inven = wire according to the present invention

TABLE 3

Various properties of SCM420 steel wires (drawn after the quenching and tempering)

| | Yield strength (Kgf/mm$^2$) | n value | n × YS (Kgf/mm$^2$) | Tensile strength (Kgf/mm$^2$) | elongation (%) | Hcrit (%) | Reduction in area (%) | Crack | Remark |
|---|---|---|---|---|---|---|---|---|---|
| 1 | 132.9 | 0.01 | 1.33 | 151.1 | 9.8 | 36.8 | 5.0 | presence | *comp |
| 2 | 92.0 | 0.02 | 1.84 | 103.4 | 15.7 | 42.0 | 10.0 | none | *inven |
| 3 | 102.8 | 0.01 | 1.03 | 120.9 | 8.7 | 29.8 | 25.0 | presence | *comp |
| 4 | 118.3 | 0.03 | 3.55 | 134.4 | 14.9 | 48.0 | 17.8 | none | *inven |
| 5 | 91.7 | 0.07 | 6.42 | 110.5 | 17.8 | 46.8 | 8.8 | none | *inven |
| 6 | 109.0 | 0.05 | 5.45 | 121.1 | 16.3 | 47.6 | 21.8 | none | *inven |
| 7 | 81.2 | 0.09 | 7.31 | 89.2 | 11.3 | 43.7 | 25.0 | none | *inven |
| 8 | 62.6 | 0.10 | 6.26 | 72.8 | 15.3 | 46.7 | 19.8 | none | *inven |
| 9 | 117.2 | 0.07 | 8.20 | 127.2 | 16.7 | 42.1 | 15.0 | none | *inven |
| 10 | 125.2 | 0.07 | 8.76 | 131.8 | 9.3 | 35.4 | 25.0 | presence | *comp |

Note:
*comp = comparative wire
*inven = wire according to the present invention

TABLE 4

Various properties of S22C steel wires (drawn after the quenching and tempering)

| | Yield strength (Kgf/mm$^2$) | N value | N × YS (Kgf/mm$^2$) | Tensile strength (Kgf/mm$^2$) | elongation (%) | Hcrit (%) | Reduction in area (%) | Crack | Remark |
|---|---|---|---|---|---|---|---|---|---|
| 1 | 135.0 | 0.01 | 1.35 | 150.0 | 10.3 | 38.0 | 12.0 | presence | *comp |
| 2 | 101.6 | 0.04 | 4.06 | 118.2 | 16.7 | 55.1 | 5.1 | none | *inven |
| 3 | 115.0 | 0.02 | 2.30 | 130.7 | 13.4 | 48.1 | 16.0 | none | *inven |
| 4 | 71.8 | 0.09 | 6.46 | 88.7 | 17.5 | 52.1 | 8.9 | none | *inven |
| 5 | 111.1 | 0.01 | 1.11 | 122.1 | 9.7 | 35.0 | 25.0 | presence | *comp |
| 6 | 83.6 | 0.06 | 5.02 | 101.9 | 16.7 | 55.3 | 10.1 | none | *inven |
| 7 | 90.3 | 0.10 | 9.03 | 98.2 | 11.6 | 33.6 | 24.1 | presence | *comp |
| 8 | 68.9 | 0.11 | 7.58 | 81.4 | 18.2 | 47.6 | 6.9 | none | *inven |
| 9 | 83.2 | 0.10 | 8.32 | 98.3 | 16.8 | 42.7 | 13.5 | none | *inven |
| 10 | 96.1 | 0.09 | 8.65 | 109.3 | 15.3 | 38.9 | 15.0 | presence | *comp |

Note:
*comp = comparative wire
*inven = wire according to the present invention

As described above, steel wires according to the present invention provide the following advantages.

1) It is not necessary for a manufacturer to perform heating for spheroidizing annealing for a long time, and it is possible to produce heat treated steel wires having forging properties equal or superior to properties obtained from the spheroidizing annealing by quenching and tempering treatments in a short period of time.

2) Machine components do not have to be subjected to quenching and tempering treatments which are additionally performed to enhance strengths obtained after cold forging procedure. Therefore, since it is possible to accomplish energy saving and improvement of working conditions and to produce machine components having strengths and toughness equal or superior to those of conventional wires by only cold forging procedure, management of product quality and process are simplified, resulting in improvement in productivity.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A steel wire having quenched and tempered structure which precludes the need to anneal the wire prior to a cold forging process, wherein the wire is defined by a product (n×YS) of a yield strength (YS) and a work hardening coefficient (n), obtained by a tensile test performed with respect to the steel wire, is within a range of 4.0–11.0 $kgf/mm^2$.

2. A steel wire produced by drawing the steel wire according to claim 1, wherein the wire is defined by a product (n×YS) of a yield strength (YS) and a work hardening coefficient (n), obtained by a tensile test performed with respect to the drawn steel wire, is within a range of 1.5–8.5 $kgf/mm^2$.

3. A high tensile machine component cold forged from the steel wire according to claim 2, wherein additional quenching and tempering treatments are not required to increase the strength of said component.

4. The high tensile machine component of claim 3 wherein said component comprises a bolt.

* * * * *